US007434573B2

(12) United States Patent
Orr

(10) Patent No.: US 7,434,573 B2
(45) Date of Patent: Oct. 14, 2008

(54) FIBER OPTIC PAINTBALL MARKER

(75) Inventor: Jeffrey George Orr, Corona, CA (US)

(73) Assignee: J.T. Sports, LLC, Bentonville, AR (US)

( * ) Notice: Subject to any disclaimer, the term of this patent is extended or adjusted under 35 U.S.C. 154(b) by 358 days.

(21) Appl. No.: 11/216,301

(22) Filed: Aug. 31, 2005

(65) Prior Publication Data

US 2006/0042616 A1 Mar. 2, 2006

Related U.S. Application Data

(60) Provisional application No. 60/606,064, filed on Aug. 31, 2004.

(51) Int. Cl.
*F41B 11/00* (2006.01)

(52) U.S. Cl. ..... 124/32; 124/73

(58) Field of Classification Search ..... 124/32, 124/73, 74

See application file for complete search history.

(56) References Cited

U.S. PATENT DOCUMENTS

| | | | | |
|---|---|---|---|---|
| 645,932 | A | 3/1900 | Ferrant | 89/125 |
| 1,167,178 | A | 1/1916 | Hill | 124/56 |
| 1,343,127 | A | 6/1920 | Hallinan | 124/54 |
| 1,743,576 | A | 1/1930 | Smith | 124/72 |
| 2,550,887 | A | 5/1951 | Tratsch | 124/1 |
| 2,568,432 | A | 9/1951 | Cook | 124/13 |
| 2,834,332 | A | 5/1958 | Guthrie | 124/13 |
| 2,845,055 | A | 7/1958 | Collins et al. | 124/11 |
| 3,089,476 | A | 5/1963 | Wolverton | 124/11 |
| 3,240,200 | A | 3/1966 | Jones | 124/11 |
| 3,273,553 | A | 9/1966 | Doyle | 124/3 |
| 3,374,708 | A | 3/1968 | Wall et al. | 89/1 |
| 3,494,344 | A | 2/1970 | Vadas et al. | 124/11 |
| 3,548,708 | A | 12/1970 | Hubigh | 89/1.818 |
| 3,572,310 | A | 3/1971 | Chiba | 124/11 |
| 3,695,246 | A | 10/1972 | Filippi et al. | 124/11 |
| 3,818,887 | A | 6/1974 | Akiyama et al. | 124/15 |
| 3,899,845 | A | 8/1975 | Wild et al. | 42/69 |
| 3,923,033 | A | 12/1975 | Laporte et al. | 124/8 |
| 4,066,000 | A | 1/1978 | Rostocil | 89/198 |
| 4,347,679 | A | 9/1982 | Grunig et al. | 42/84 |
| 4,362,145 | A | 12/1982 | Stelcher | 124/32 |
| 4,365,439 | A * | 12/1982 | Litynski | 446/406 |
| 4,602,608 | A | 7/1986 | Lacam et al. | 124/74 |
| 4,679,487 | A | 7/1987 | Houseman | 89/140 |
| 4,694,815 | A | 9/1987 | Hung | 124/27 |
| 4,770,153 | A | 9/1988 | Edelman | 124/72 |
| 4,779,245 | A | 10/1988 | Chelminski | 367/144 |

(Continued)

*Primary Examiner*—John Ricci
(74) *Attorney, Agent, or Firm*—Keisling Pieper & Scott PLC; David B. Pieper; Trent C. Keisling

(57) ABSTRACT

A paintball marker utilizing fiber optic cables and quick disconnects to create an isolated electrical circuit which is more robust to environmental effects while improving marker balance by relocating the sensor weight. A paintball marker is provided using a frame structure defining a mounting area and a distal sensing area with an optical sensor connected to the frame at the mounting area and a fiber optic cable connected between the optical sensor and the distal sensing area. Both reflective and broken beams sensors are taught for use with the present invention as well as a light source providing light through an optic supply line connected between the light source and the distal sensing area.

23 Claims, 2 Drawing Sheets

U.S. PATENT DOCUMENTS

| | | | | | |
|---|---|---|---|---|---|
| 4,819,609 | A | | 4/1989 | Tippmann | 124/72 |
| 4,899,717 | A | | 2/1990 | Rutten et al. | 124/67 |
| 4,936,282 | A | | 6/1990 | Dobbins et al. | 124/74 |
| 4,958,929 | A | * | 9/1990 | Kondo | 356/487 |
| 5,063,905 | A | | 11/1991 | Farrell | 124/72 |
| 5,078,118 | A | | 1/1992 | Perrone | 124/74 |
| 5,149,898 | A | | 9/1992 | Chesnut et al. | 42/69.01 |
| 5,228,427 | A | | 7/1993 | Gardner, Jr. | 124/71 |
| 5,261,384 | A | | 11/1993 | Hu | 124/66 |
| 5,280,778 | A | | 1/1994 | Kotsiopoulos | 124/73 |
| 5,301,448 | A | * | 4/1994 | Petrick et al. | 42/70.01 |
| 5,349,939 | A | | 9/1994 | Perrone | 124/76 |
| 5,363,834 | A | | 11/1994 | Stuchlik | 124/76 |
| 5,462,042 | A | | 10/1995 | Grenwell | 124/76 |
| 5,503,137 | A | | 4/1996 | Fusco | 124/72 |
| 5,613,483 | A | | 3/1997 | Lukas et al. | 124/73 |
| 5,634,456 | A | | 6/1997 | Perrone | 124/76 |
| 5,727,538 | A | | 3/1998 | Ellis | 124/77 |
| 5,878,736 | A | | 3/1999 | Lotuaco, III | 124/71 |
| 5,881,707 | A | | 3/1999 | Gardner, Jr. | 124/77 |
| 5,913,303 | A | | 6/1999 | Kotsiopoulos | 124/31 |
| 5,967,133 | A | | 10/1999 | Gardner, Jr. | 124/77 |
| 6,003,504 | A | | 12/1999 | Rice et al. | 124/73 |
| 6,035,843 | A | | 3/2000 | Smith et al. | 124/77 |
| 6,048,280 | A | | 4/2000 | Palmer et al. | 473/416 |
| 6,065,460 | A | | 5/2000 | Lotuaco, III | 124/72 |
| 6,138,656 | A | | 10/2000 | Rice et al. | 124/73 |
| 6,311,682 | B1 | | 11/2001 | Rice et al. | 124/71 |
| 6,349,711 | B1 | | 2/2002 | Perry et al. | 124/73 |
| 6,439,217 | B1 | | 8/2002 | Shih | 124/77 |
| 6,474,326 | B1 | | 11/2002 | Smith et al. | 124/77 |
| 6,494,194 | B2 | | 12/2002 | Shipachev et al. | 124/73 |
| 6,532,949 | B1 | | 3/2003 | McKendrick | 124/77 |
| 6,550,468 | B1 | | 4/2003 | Tippmann, Jr. | 124/71 |
| 6,553,983 | B1 | | 4/2003 | Li | 124/73 |
| 6,578,566 | B2 | | 6/2003 | Hernandez | 124/73 |
| 6,590,386 | B1 | | 7/2003 | Williams | 324/178 |
| 6,615,814 | B1 | | 9/2003 | Rice et al. | 124/71 |
| 6,626,165 | B1 | | 9/2003 | Bhogal | 124/77 |
| 6,637,420 | B2 | | 10/2003 | Moritz | 124/73 |
| 6,637,421 | B2 | | 10/2003 | Smith et al. | 124/77 |
| 6,644,295 | B2 | | 11/2003 | Jones | 124/77 |
| 6,644,296 | B2 | | 11/2003 | Gardner, Jr. | 124/77 |
| 6,658,982 | B2 | | 12/2003 | Cherry | 89/1.42 |
| 6,694,963 | B1 | | 2/2004 | Taylor | 124/32 |
| 6,705,036 | B2 | | 3/2004 | Orr | 42/69.01 |
| 6,748,938 | B2 | | 6/2004 | Rice et al. | 124/77 |
| 6,763,822 | B1 | | 7/2004 | Styles | 124/77 |
| 6,785,995 | B2 | * | 9/2004 | Herzog et al. | 42/70.07 |
| 6,802,306 | B1 | | 10/2004 | Rice | 124/74 |
| 2003/0131514 | A1 | | 7/2003 | Rice et al. | 42/69.01 |
| 2003/0131834 | A1 | | 7/2003 | Rice et al. | 124/32 |
| 2003/0154968 | A1 | | 8/2003 | Rice et al. | 124/71 |
| 2003/0178018 | A1 | | 9/2003 | Cherry | 124/76 |
| 2003/0221684 | A1 | | 12/2003 | Rice | 124/71 |
| 2004/0011344 | A1 | | 1/2004 | Rice et al. | 124/73 |
| 2004/0084040 | A1 | | 5/2004 | Jones | 124/77 |

* cited by examiner 100
200
202
203
204
206
208
210
212
214
216
218
220
222
224
226
228
230
232
234
236
238
240
242
244
246
248
250
252
254
256
258
260
262
264
266
268
270
272
274
276
278
280
282

FIBER OPTIC PAINTBALL MARKER

CROSS-REFERENCE TO RELATED APPLICATIONS

This application claims priority to and is a continuation-in-part of provisional application Ser. No. 60/606,064, filed Aug. 31, 2004.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball markers for launching paintballs as projectiles. In particular, the present invention relates specifically to an improvement in paintball markers utilizing optical sensors. Known art may be found in U.S. Class/subclass 124/77; 124/32; 124/54; 324/178; 42/1.01; 124/71 as well as in other classes and subclasses.

2. Description of the Known Art

As will be appreciated by those skilled in the art, paintball markers are being designed with increasing complex electronics. Patents disclosing information relevant to paintball markers with optical sensors include U.S. Pat. No. 5,727,538, issued to Ellis on Mar. 17, 1998, entitled Electronically actuated marking pellet projector; and U.S. Pat. No. 6,590,386, issued to Williams on Jul. 8, 2003, entitled Electronics system for use with projectile firing devices. Each of these patents is hereby expressly incorporated by reference in their entirety.

Specifically noting the teachings of U.S. Pat. No. 6,590,386, issued to Williams on Jul. 8, 2003, entitled Electronics system for use with projectile firing devices, one may see the current state of paintball markers using optical detection means. This patent shows the use of an optical detection system that places the detector at the specific point of detection. As noted by the disclosure and the housings shown in FIGS. 1 through 3*d* of this patent, the placement of the actual sensor at the detecting area results in large bulk and weight placed out on the lever arm of the barrel which gives a forward weight shift to the marker. This placement also exposes the detector to the harsh environment that paintball markers face during use. Finally, this placement also interferes with the look and design of the marker. The present invention overcomes these disadvantages.

As noted in the problems associated with the prior art, paintball markers are exposed to extreme and harsh environments both on and off the playing field. In addition to the normal effects of operating the markers, markers get exposed to water, humidity, high speed impacts from paintballs shot by other players as well as the marker being banged against obstacles, jarring movements during both play with the marker as well as shipment and transportation, and high and low temperatures including those found in shipment containers or the trunks of automobiles during normal weather cycles. Still further, sand and dust from the environment collect on the markers and can penetrate into the inner workings of the marker. Also, salt corrosion becomes a problem in coastal areas. The prior art fails to teach designs to overcome these problems.

Thus, it may be seen that these prior art patents are very limited in their teaching and utilization, and an improved marker is needed to overcome these limitations.

SUMMARY OF THE INVENTION

The present invention is directed to an improved paintball marker utilizing fiber optic cables and quick disconnects to create an isolated electrical circuit which is more robust to environmental effects while improving marker balance by relocating the sensor weight. In accordance with one exemplary embodiment of the present invention, a paintball marker is provided using a frame structure defining a mounting area and a distal sensing area with an optical sensor connected to the frame at the mounting area and a fiber optic cable connected between the optical sensor and the distal sensing area. Distal sensing areas include a projectile loading area; a breech area; a barrel area; a valve area; and a trigger area. Reflective, refractive, and broken beams sensors are taught for use with the present invention as well as a separate light source providing light through an optic supply line connected between the light source and the distal sensing area.

Objects of the present invention include isolation of the electric circuit from the marker; removing optical sensors from the harsh paintball environment and encasing them in a protective area such as the body of the marker or a hollow trigger handle; monitoring areas that are difficult to reach with bulky sensors by utilizing fiber optic transmition capabilities to remotely position the sensors, improving the balance of the marker by moving the weight of the sensor to a rearward or neutral position while adding only minimal weight associated with an optical cable; improving the speed of repair of a marker by centralizing the electrical board, and providing quick disconnects for the fiber optic system at either the cable to sensor interface or the sensor to electrical circuit interface.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
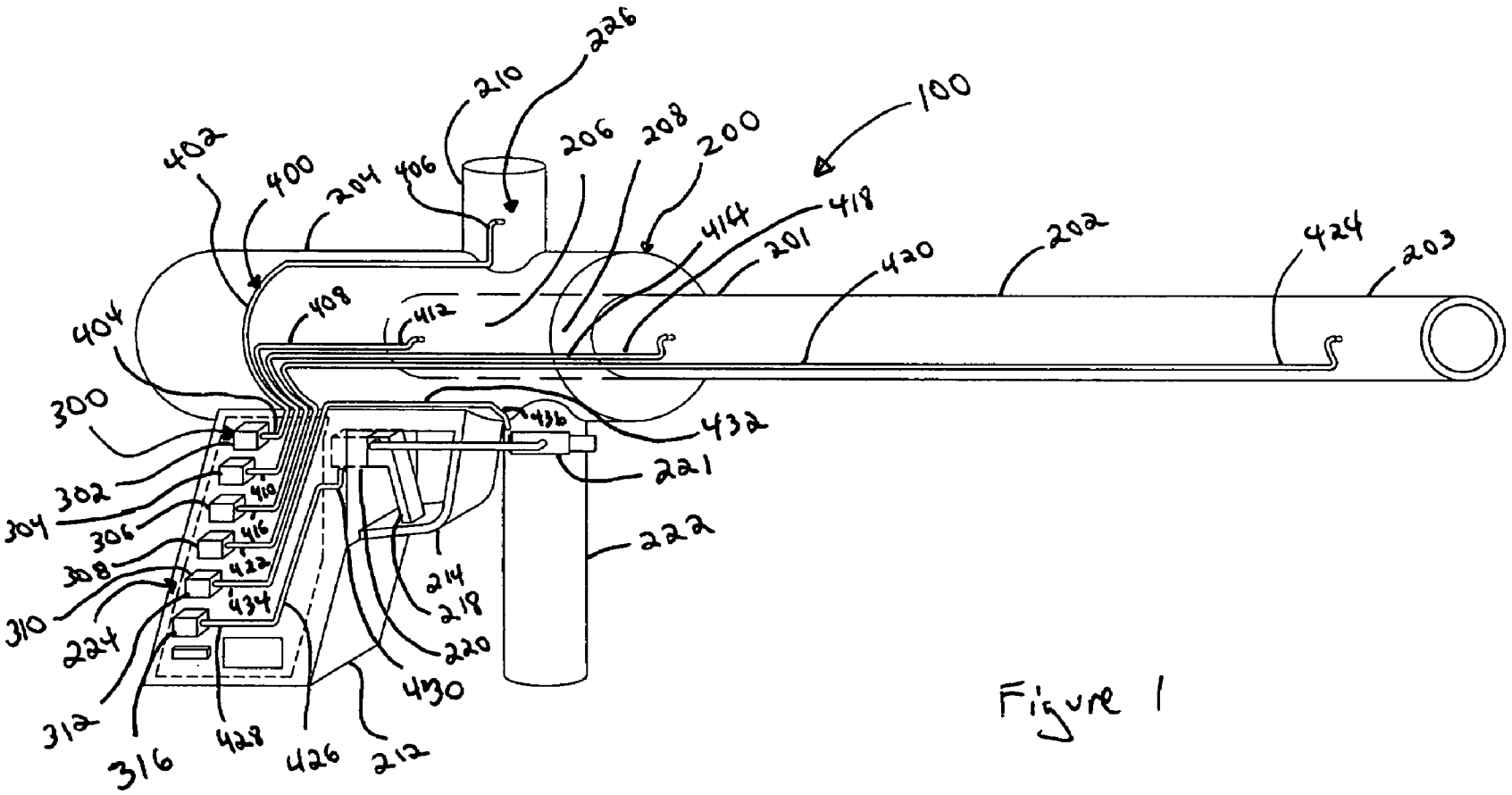
FIG. 1 is a schematic view of a paintball marker using an isolated electric circuit with fiber optic cables reaching various sensing locations.

As shown in FIG. 1 of the drawings, one exemplary embodiment of the present invention is generally shown as a paintball marker 100 having a frame structure 200. The frame structure 200 includes a barrel 202 mounted to the body 204. The barrel 202 includes a body proximal barrel end 201 and a body distal barrel end 203. The body 204 defines a projectile loading area 206 and a breech 208 aligned with the bore of the barrel 202. A projectile receiver 210 is mounted to the top of the body 202 and a trigger frame 212 is mounted underneath. The trigger frame includes a main body 213 and a trigger guard 214 protecting a trigger 216 which includes a lever arm 218 mounted to a trigger body 220. A regulator 222 is also mounted to the body 204. For convenience when referring to areas of the body, the attachment location for an optical sensors will generally be referred to as a mounting area 224 and the location which is to be monitored by the optical sensors will generally be referred to as a distal sensing area 226.

An optical sensor 300 is provided for monitoring the operation of the paintball marker 100. The optical sensor 300 is remotely located from the sensing area 226. The present invention uses a fiber-optic cable 400 connected to the remote optical sensor 300. In a typical sensor 300, the sensor's emitter and the receiver share a single housing. In the present invention, a fiber-optic cable 400 is connected to the sensor housing. The cable 400 transports light into and out of the sensing area. Standard photoelectric sensing modes such as diffuse reflective, through-beam, and retro-reflective may be utilized with the appropriate individual and/or bifurcated cabling 400. Typical optical sensors 300 utilized with the preferred embodiment use robust infrared detectors. Manufacturers of opticals sensors 300 include Omron, Keyence Corp. of America in Woodcliff Lake, N.J.; Banner Engineering Corp. in Minneapolis, Minn.; and SUNX Sensors in West Des Moines, Iowa. Several different placements of optical sensors 300 may be used for the marker 100, although the preferred embodiment uses the trigger frame 212 for the present marker 100.

The present invention's use of fiber optic cable 400 is to be able to move the optical sensor 300 into a protected area away from the harsh environments found in the actual area that is to be sensed or monitored and obtain the isolation and weight benefits from this repositioning of the sensor 300. Because optical fiber is essentially a passive, mechanical component of a fiber-optic sensing system, it doesn't use moving parts or electrical circuitry and is therefore completely immune to all forms of electrical interference. This characteristic makes it an ideal way to isolate the sensing system electronics from electrical interference and limit the sparking possibilities from the electrical circuitry. For our preferred embodiment, we have chosen to create an isolated electrical circuit 700 such that the battery 708, optical sensors 300, the audible and visual display 702, and the processor 704 may all be mounted to a convenient circuit board 706 that is isolated from the rest of the marker 100. This eliminates cross talk between other electronics which may be used such as paintball loaders, field timers, or other electrical circuits that may come in contact with a marker 100. This also allows for isolation of all spark capable electronics should this be necessary.

The preferred embodiment uses a line type placement of optical sensors 300 with each of the various sensor locations noted as an optical receiver sensor 302, an optical breech sensor 304, an optical proximal barrel sensor 306, an optical distal barrel sensor 308, an optical trigger sensor 310 and an optical valve sensor 316. These sensors may be of any known type, and preferably uses an environmentally rugged construction such as that found in either a reflective beam sensor 312 or a broken beam sensor 314. For the preferred embodiment shown, a reflective beam sensor is shown for each of the optical receiver sensor 302, optical breech sensor 304, optical proximal barrel sensor 306, optical distal barrel sensor 308, and the optical valve sensor 316. In FIG. 1, a reflective beam sensor is shown for the trigger sensor 310 while FIG. 2 shows a broken beam sensor 314 for the optical trigger sensor 310.

Each of the sensors 300 is linked to the actual sensing location using an optically transmitting material 400 generally referred to as a fiber optic cable 400. A bifurcated fiber-optic assembly is used for both diffuse reflective and retroreflective sensing. In contrast to an individual cable, a bifurcated cable combines the emitter and the receiver cable assemblies into one assembly. The emitter and receiver strands are laid side-by-side along the length of the cable and are randomly mixed at the sensing point providing a compact sensing tip. When an object is in front of the sensing tip of the bifurcated cable, light from the emitter cable reflects off the object and back into the receiver of the remote sensor via the receiver cable, and detection is achieved. The cables 400 include an optical receiver cable 402 having a sensor end 404 connected to the optical receiver sensor 302 and an area end 406 terminating at the receiver 210. An optical breech cable 408 is connected at a sensor end 410 to the breech sensor 304 and the area end 412 terminated at the breech 208. An optical proximal barrel cable 414 is connected at a sensor end 416 to the proximal barrel sensor 306 and is terminated with an area end 418 at the proximal barrel end 201. An optical distal barrel cable 420 is connected at a sensor end 422 to the distal barrel sensor 308 and is terminated at an area end 424 at the distal barrel end 203. An optical trigger cable 426 is connected at a sensor end 428 to the trigger sensor 310 and is terminated at an area end 430 at the trigger body 220. FIG. 1 shows a reflective beam sensor used for the trigger sensor 310. Finally, an optical valve cable 432 is connected at a sensor end 434 to a valve sensor 316 and is terminated at an area end 436 at any one of the marker valves, shown in the preferred embodiment as the control valve 221.

Figure 2:
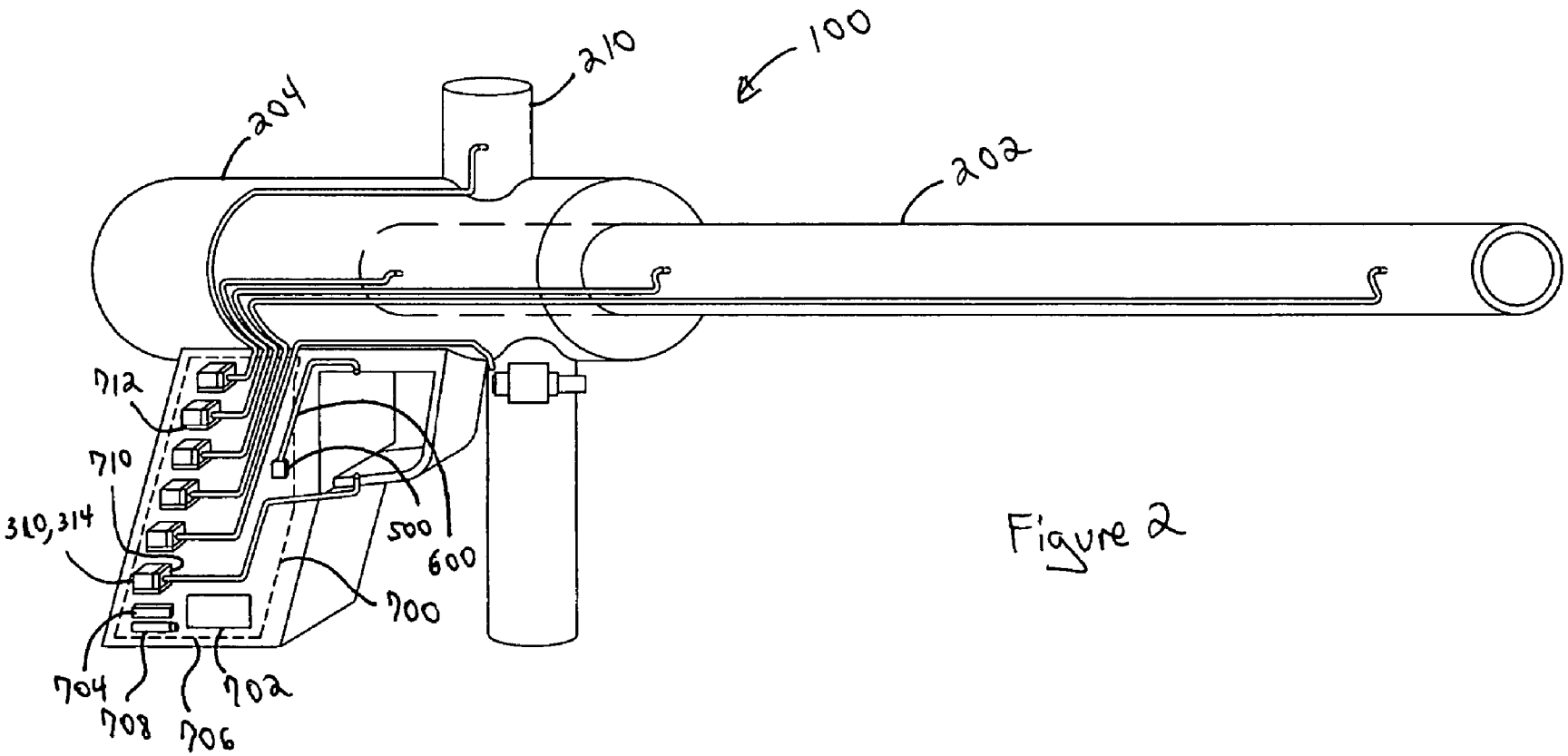
FIG. 2 is a schematic view of a paintball marker using an isolated electric circuit with fiber optic cables reaching various sensing locations including a broken beam sensor and optical couplings.

FIG. 2 shows the trigger sensor 310 using a broken beam type sensor with a double cable run such that an additional optic supply line 600 is used to carry light from a light source 500 to the other side of the trigger sensing area. As with standard through-beam photoelectric sensing, the emitter and detector cables are positioned opposite each other. Sensing is achieved when the light beam that extends from the emitter to the receiver fiber-optic cable is interrupted. Also shown in this embodiment is the use of quick optical disconnects 710 for the cables 402, 408, 414, 420, 426, 436 and the use of an electrical disconnect 712 such that the electrical circuit 700 may be easily removed. While the present invention prefers that the optical sensors 300 be placed on the same board as the processor, battery, and visual display, it should also be noted that a separate optical board may be used with a quick disconnect into the electrical circuit board without departing form the spirit of this invention. Any of these types of construction and/or sensors may be selectively chosen and combined for any type of sensor placement.

Note that the present invention describes the placement of sensors for the preferred embodiment and these placements should not be constructed to limit the types of sensors or their placement for this invention. The basis of this invention is to move the fibber optic sensor out of the harsh environment that is taught by the prior art using fiber optic cables to move the optical information to a more protective environment. This invention also allows for the complete isolation and containment of the electrical circuitry of the component to remove exposure of its effects from the rest of the marker. Finally, this provides for a method for improving the balance of the marker by relocating the weight of the sensor.

Reference numerals used throughout the detailed description and the drawings correspond to the following elements:

a paintball marker 100
a frame structure 200
a proximal barrel end 201
a barrel 202
a distal barrel end 203
a body 204
a projectile loading area 206
a breech 208
a projectile receiver 210
a trigger frame 212
a trigger guard 214
a trigger 216
a lever arm 218
a trigger body 220
a regulator 222
a control valve 221
a mounting area 224
a distal sensing area 226
an optical sensor 300
an optical receiver sensor 302
an optical breech sensor 304
an optical proximal barrel sensor 306
an optical distal barrel sensor 308
an optical trigger sensor 310
a reflective beam sensor 312
a broken beam sensor 314
an optical valve sensor 316
an optically transmitting material 400
an optical receiver cable 402
a sensor end 404
an area end 406
an optical breech cable 408
a sensor end 410
an area end 412
an optical proximal barrel cable 414
a sensor end 416
an area end 418
an optical distal barrel cable 420
a sensor end 422
an area end 424
an optical trigger cable 426
a sensor end 428
an area end 430
an optical valve cable 432
a sensor end 434
an area end 436
a light source 500
a first optic supply line 600
an isolated electrical circuit 700
a visual display 702
a processor 704
a circuit board 706
a battery 708
an optical disconnect coupler 710
an electrical disconnect coupler 712

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A paintball marker comprising:

a frame structure defining a mounting area and a distal sensing area;

the frame structure including a barrel, a projectile loading area, a breech, and a trigger;

an optical sensor connected to the frame at the mounting area; and at least one optically transmitting material connected to transfer previously unsensed information to the optical sensor from the distal sensing area.

2. The paintball marker of claim 1, the distal sensing area comprising a projectile loading area.

3. The paintball marker of claim 1, the distal sensing area comprising a breech area.

4. The paintball marker of claim 1, the distal sensing area comprising a barrel area.

5. The paintball marker of claim 1, the distal sensing area comprising a valve area.

6. The paintball marker of claim 1, the distal sensing area comprising a trigger area.

7. The paintball marker of claim 1, further comprising:

a light source, the at least one optically transmitting material comprising a first optic supply line connected between the light source and the distal sensing area.

8. The paintball marker of claim 1, the optical sensor comprising a broken beam sensor;

the at least one optically transmitting material further comprising a second optic receive line connected between the distal sensing area and the broken beam sensor.

9. The paintball marker of claim 1, the optical sensor comprising a reflective beam sensor;

the at least one optically transmitting material further comprising a second optic receive line connected between the distal sensing area and the reflective beam sensor.

10. The paintball marker of claim 1, the optical sensor electrically connected as part of an isolated electrical circuit.

11. A paintball marker comprising:

a frame means for supporting an optical sensing means distally from a sensing area, the optical sensing means for detecting a light change; and the frame means including a barrel, a projectile loading area, a breech, and a trigger; and at least one optical transmitting means for transmitting previously unsensed optical. information from the sensing area to the optical sensing means.

12. The paintball marker of claim 11, the sensing area comprising a projectile loading area.

13. The paintball marker of claim 11, the sensing area comprising a breech area.

14. The paintball marker of claim 11, the sensing area comprising a barrel area.

15. The paintball marker of claim 11, the sensing area comprising a valve area.

16. The paintball marker of claim 11, the sensing area comprising a trigger area.

17. The paintball marker of claim 11, further comprising:

a light supply means for generating a light, the at least one optically transmitting means comprising a first optic means for conveying the light to the sensing area.

18. The paintball marker of claim 11, the optical sensing means comprising a broken beam sensor;

the at least one optically transmitting means further comprising a second optic means for conveying light information from the distal sensing area to the broken beam sensor.

19. The paintball marker of claim 11, the optical sensing means comprising a reflective beam sensor;

the at least one optically transmitting means further comprising a second optic means for conveying light information from the distal sensing area to the reflective beam sensor.

20. The paintball marker of claim 11, the optical sensing means electrically connected as part of an isolated electrical circuit.

21. A paintball marker comprising:

a frame structure defining a mounting area and a distal sensing area;

the frame structure including a barrel, a projectile loading area, a breech, and a trigger;

an optical sensor connected to the frame at the mounting area, the optical sensor having a sensor weight; and at least one optically transmitting material having a material weight less than the sensor weight, the optically transmitting material connected between the optical sensor and the distal sensing area.

22. The marker of claim 21, wherein the sensor weight is positioned in proximity to a neutral balance area.

23. A paintball marker comprising:

a frame structure defining a mounting area and a distal sensing area;

the frame structure including a barrel, a projectile loading area, a breech, and a trigger;

an electrical circuit including an optical system including an optical sensor connected to the frame at the mounting area and at least one optically transmitting material connected between the optical sensor and the distal sensing area; and a disconnect attached to the optical sensor to allow removal of the electrical circuit from the frame structure.

* * * * *